US008923741B2

(12) United States Patent
Imaizumi

(10) Patent No.: US 8,923,741 B2
(45) Date of Patent: Dec. 30, 2014

(54) FIXING APPARATUS

(75) Inventor: Toru Imaizumi, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/607,006

(22) Filed: Sep. 7, 2012

(65) Prior Publication Data

US 2013/0078017 A1 Mar. 28, 2013

(30) Foreign Application Priority Data

Sep. 28, 2011 (JP) ..... 2011-212960

(51) Int. Cl.
*G03G 15/20* (2006.01)

(52) U.S. Cl.
CPC .... *G03G 15/2064* (2013.01); *G03G 2215/2035* (2013.01); *G03G 15/2053* (2013.01)
USPC ..... 399/329

(58) Field of Classification Search
CPC ..... G03G 15/20
USPC ..... 399/329
See application file for complete search history.

(56) References Cited

U.S. PATENT DOCUMENTS

| | | | | |
|---|---|---|---|---|
| 6,040,558 | A * | 3/2000 | Yamazaki | 219/216 |
| 7,130,572 | B2 * | 10/2006 | Kubochi et al. | 399/329 |
| 7,235,761 | B1 * | 6/2007 | Maul et al. | 219/216 |
| 7,469,120 | B2 * | 12/2008 | Iwasaki et al. | 399/328 |
| 7,991,341 | B2 * | 8/2011 | Matsunaka et al. | 399/333 |
| 8,107,871 | B2 * | 1/2012 | Finn et al. | 399/334 |
| 8,452,218 | B2 * | 5/2013 | Fujiwara et al. | 399/329 |
| 2005/0180788 | A1 * | 8/2005 | Watanabe et al. | 399/328 |
| 2006/0233575 | A1 * | 10/2006 | Uchida et al. | 399/329 |
| 2010/0247169 | A1 * | 9/2010 | Hayashi | 399/302 |
| 2010/0278569 | A1 * | 11/2010 | Finn et al. | 399/329 |
| 2011/0045310 | A1 * | 2/2011 | Kishino et al. | 428/474.4 |
| 2011/0129267 | A1 * | 6/2011 | Arimoto et al. | 399/329 |
| 2011/0206409 | A1 * | 8/2011 | Kondo et al. | 399/92 |
| 2011/0229226 | A1 * | 9/2011 | Tokuda et al. | 399/329 |
| 2012/0230742 | A1 * | 9/2012 | Nakagawa et al. | 399/329 |
| 2013/0078017 | A1 * | 3/2013 | Imaizumi | 399/329 |
| 2013/0202333 | A1 * | 8/2013 | Sugimoto | 399/329 |

FOREIGN PATENT DOCUMENTS

| | | | |
|---|---|---|---|
| JP | 2002-246151 | A | 8/2002 |
| JP | 3814542 | A | 8/2006 |

* cited by examiner

*Primary Examiner* — Clayton E Laballe
*Assistant Examiner* — Kevin Butler
(74) *Attorney, Agent, or Firm* — Canon USA Inc. IP Division

(57) ABSTRACT

A fixing apparatus for fixing a toner image onto a recording material by heating the recording material bearing the toner image at a nip portion while conveying the recording material includes a tubular film, a nip portion forming member in contact with an inner surface of the film, a pressure member that forms the nip portion with the nip portion forming member via the film, and a regulation member for regulating a movement of the film that includes a first regulation surface facing an inner face of the film to regulate the movement of the film in a radial direction of film and an second regulation surface facing an end surface of the film to regulate the movement of film in a generatrix direction of the film. The second regulation surface includes a concave and curved surface area.

20 Claims, 16 Drawing Sheets

FIXING APPARATUS

This application claims priority from Japanese Patent Application No. 2011-212960 filed Sep. 28, 2011, which is hereby incorporated by reference herein in its entirety.

BACKGROUND OF THE INVENTION

1. Field of the Invention

The present invention relates to a fixing apparatus which is used in an electrophotographic image forming apparatus such as a copying machine or a laser printer and configured to fix an unfixed toner image formed on a recording material to the recording material by heating and pressurization.

2. Description of the Related Art

As a fixing apparatus to be used in an electrophotographic image forming apparatus, there is used a film fixing type fixing apparatus that is superior in on-demand property.

A film fixing type fixing apparatus includes a tubular film, a heater held in contact with an inner surface of the film, and a pressure member forming a nip portion together with the heater through the intermediation of the film. A recording material which bears a toner image is heated at the nip portion while being conveyed, so that the toner image is fixed to the recording material.

In order to quickly raise the film temperature to a target temperature, a film heating type fixing apparatus uses a film of small heat capacity. As the film material, there is used a metal material such as a stainless steel or nickel, or a heat resistant resin material such as polyimide. Generally, a metal material has a higher strength as compared with a resin material, so that it allows thinning. Further, the metal material has a higher heat conductivity. On the other hand, a resin material has a smaller specific weight as compared with metal, and has small heat capacity, so that it can be easily warmed. Further, a resin material can be formed into a thin film through coating molding, so that resin material can be molded at low cost.

In the film heating type fixing apparatus, due to a design tolerance, or the like, deviation in a degree of parallelization between the pressure member and the film or a difference in pressurization force between the right and left sides may occur. In such cases, deviation of the film may occur in a direction orthogonal to a recording material conveyance direction of the film (hereinafter, this will be referred to as film deviation).

Japanese Patent Application Laid-Open No. 2002-246151 and Japanese Patent No. 3814542 discuss a configuration in which an end portion of a film is received by a regulation surface of a regulation member and in which some improvement is added to a shape of the end portion of the film, so that the film deviation is regulated, and it is possible to prevent damage of the end portion of the film such as bending or cracking in the end portion of the film through its flaring.

However, from the viewpoint of the recent demand of energy saving for friendliness to environment, a further reduction in power consumption is required of the fixing apparatus. To reduce the power consumption, it is effective to enhance the heat transfer efficiency from the film to the recording material, so that a further reduction in film thickness is in progress. Thus, a shortage of the strength of the end portion of the film is to be expected.

Thus, when a further reduction in film thickness is achieved, the regulation member as discussed in Japanese Patent Application Laid-Open No. 2002-246151 and Japanese Patent No. 3814542 may be insufficient as a countermeasure against damage of the end portion of the film. Because, in the regulation member discussed in Japanese Patent Application Laid-Open No. 2002-246151 and Japanese Patent No. 3814542, there is a fear of the end portion of the film being inwardly bent if a force toward an inner surface direction is applied to the end portion of the film when the film moves to a radial direction due to film deviation.

SUMMARY OF THE INVENTION

The present invention is directed to a fixing apparatus capable of suppressing damage of an end portion of a film due to film deviation even when a further reduction is film thickness is achieved.

According to an aspect disclosed herein, a fixing apparatus for fixing a toner image onto a recording material by heating the recording material bearing the toner image at a nip portion while conveying the recording material includes a tubular film, a nip portion forming member in contact with an inner surface of the film, a pressure member that forms the nip portion with the nip portion forming member via the film, and a regulation member for regulating a movement of the film that includes a first regulation surface facing an inner face of the film to regulate the movement of the film in a radial direction of film and an second regulation surface facing an end surface of the film to regulate the movement of film in a generatrix direction of the film. The second regulation surface includes a concave and curved surface area.

According to the present invention, even when a thinned film is used, it is possible to suppress damage of the end portion of the film due to film deviation.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Various exemplary embodiments, features, and aspects of the invention will be described in detail below with reference to the drawings.

Figure 1:
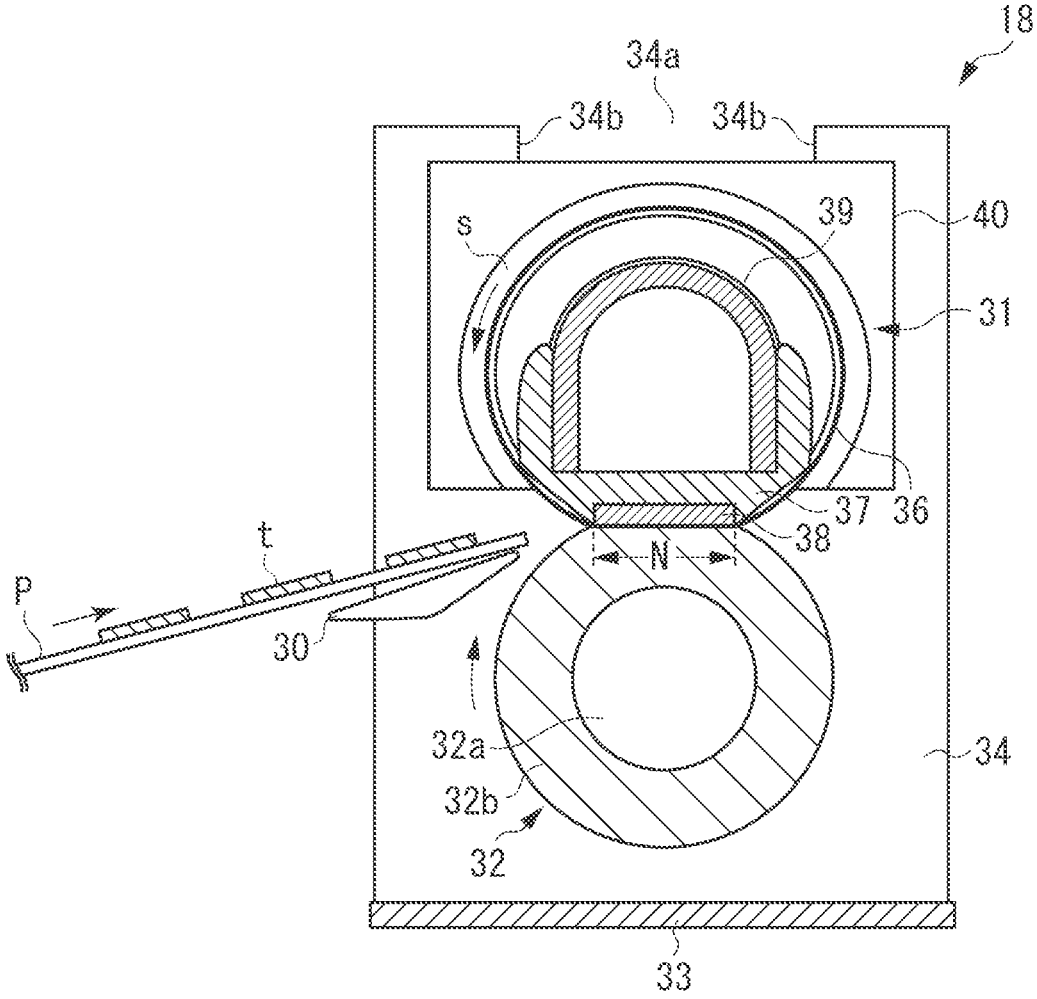
FIG. 1 is a sectional view of a fixing apparatus according to a first exemplary embodiment taken along a line perpendicular to a film generatrix direction.
Figure 2:
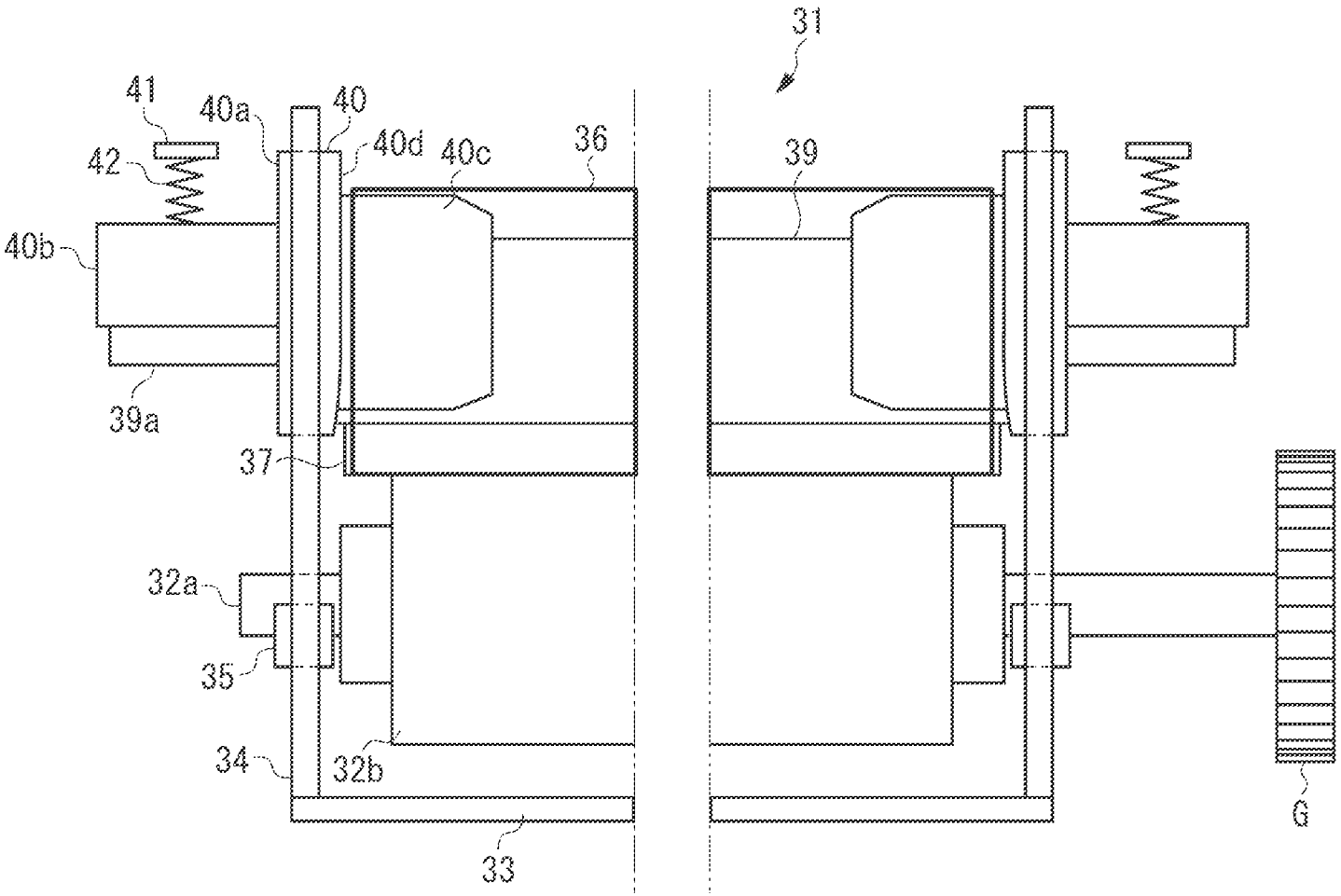
FIG. 2 is a schematic view of the fixing apparatus according to the first exemplary embodiment as seen from an upstream side in a recording material conveyance direction.

An outline of a fixing apparatus according to a first exemplary embodiment will be described. FIG. 1 is a sectional view of a fixing apparatus 18 taken along a line perpendicular to a generatrix of a film 36. FIG. 2 illustrates the fixing apparatus 18 as seen from an upstream side in a recording material conveyance direction. In the following description of the fixing apparatus, a term "longitudinal direction" refers to a direction orthogonal to the recording material conveyance direction. A term "width direction" refers to the recording material conveyance direction.

Figure 3A:
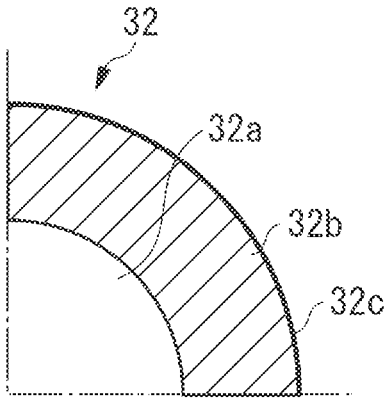
FIG. 3A is a sectional view of a pressure roller according to the first exemplary embodiment taken along a line perpendicular to an axial direction thereof.

The fixing apparatus includes a film assembly 31 including the film 36, and a pressure roller as a pressure member. As illustrated in FIG. 3A, the pressure roller 32 includes a cored bar 32*a* and an elastic layer 32*b* formed into a roller shape concentrically and integrally around the cored bar 32*a* of silicone rubber, fluorine rubber or the like. Further, a releasing layer 32*c* is formed thereon. The releasing layer 32*c* may include tetrafluoroethylene perfluoroalkyl vinyl ether copolymer (PFA), polytetrafluoroethylene (PTFE), tetrafluoroethylene hexafluoropropylene copolymer (FEP), or the like.

The pressure roller 32 used in the first exemplary embodiment is one obtained by forming a silicone rubber layer 32*b* of a thickness of approximately 3.5 mm through injection molding on the cored bar 32*a* of stainless steel having an outer diameter of 11 mm, and further, by covering the silicone rubber layer 32*b* with a PFA tube 32*c* of a thickness of approximately 40 μm. The outer diameter of the pressure roller 32 is 18 mm. As illustrated in FIG. 2, the pressure roller 32 is rotatably supported at both longitudinal ends of the cored bar 32*a* via bearing members 35 so as to be situated between apparatus frame side plates 34. The fixing apparatus is provided with a drive gear G fixed to one end portion of the cored bar 32*a* of the pressure roller.

The film assembly 31 includes the film 36, a heater 38, a guide member 37, a pressure stay 39, and a regulation member 40.

Figure 3B:
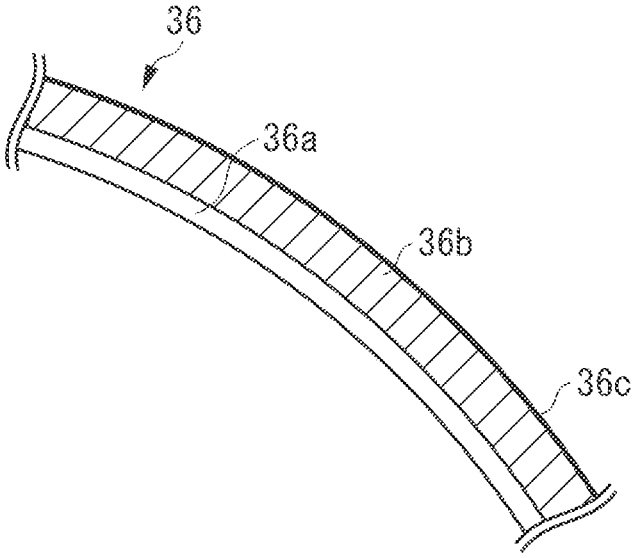
FIG. 3B is a sectional view of a film according to the first exemplary embodiment taken along a line perpendicular to a generatrix direction thereof.

The film 36 is a tubular film, and, as illustrated in FIG. 3B, includes, as from the inner surface side toward the outer surface side, a base layer 36*a* formed of heat resistant resin, an elastic layer 36*b*, and a releasing layer 36*c*. In the first exemplary embodiment, a tubular polyimide base material having a thickness of 45 μm is used as the base layer 36*a*. On the base layer 36*a*, there is formed, as the elastic layer 36*b*, a silicone rubber layer having a thickness of approximately 150 μm, and this layer is covered with a PFA tube of a thickness of 15 μm as the releasing layer 36*c*. In the first exemplary embodiment, the film 36 has an inner diameter of 18 mm.

A heater 38 as a nip portion forming member is brought into contact with the inner surface of the film 36 to heat the film 36, and forms a nip portion N together with the pressure roller 32 through the intermediation of the film 36. As a substrate of the heater 38, there is used an alumina or an aluminum nitride ceramic substrate of high insulation property and high thermal conductivity, or a resin substrate formed of a highly heat resistant resin such as polyimide, polyphenylene sulfide resin (PPS), liquid crystal polymer, or the like. In addition, an energization heat generation resistor layer formed of silver palladium or the like is formed in a linear or strip-like shape by screen printing or the like so as to extend in the longitudinal direction on the surface of the substrate. When electric power is supplied to the energization heat generation resistor layer from a power supply unit (not illustrated), the heater 38 can increase temperature. Then, the temperature of the heater is detected by a temperature sensor (not illustrated), and the power supply to the energization heat generation resistor layer from the power supply unit is controlled such that a target temperature is maintained by a control unit (not illustrated).

As illustrated in FIG. 1, the guide member 37 has a substantially semi-circular and gutter-shaped cross-sectional configuration and exhibits rigidity, heat resistance, and heat insulation property. The guide member 37 is formed of liquid crystal polymer or the like. The heater 38 is arranged so as to extend in the longitudinal direction of the guide member 37 on the side facing to the pressure roller 32.

The pressure stay 39 has a U-shaped sectional configuration as seen in a direction perpendicular to a generatrix direction of the film 36. The pressure stay 39 is elongated in the longitudinal direction of the guide member, and serves to reinforce the guide member. In the first exemplary embodiment, stainless steel is used as the material of the pressure stay 39.

As illustrated in FIG. 1, the film assembly 31 as described above is pressed against the pressure roller by a pressure spring 42 such that the heater 38 side thereof faces to the pressure roller 32.

A rotational force is transmitted to a drive gear G of the pressure roller 32 from a drive mechanism unit (not illustrated) to rotate the pressure roller 32 in a clockwise direction in FIG. 1. Through the rotation of the pressure roller 32, a frictional force is exerted at the nip portion N between the pressure roller 32 and the film 36, and thus the film 36 is rotated.

In the state in which the film 36 is being rotated and the temperature of the heater 38 has reached the target temperature and maintained thereat, a recording material P is conveyed to the nip portion N.

At the nip portion N, the recording material P bearing an unfixed toner image t is heated while conveyed, so that the toner image t on the recording material P is fixed to the recording material P. The recording material P passed through the nip portion N is curvature-separated from the surface of the film 36, and is conveyed by a discharge roller pair (not illustrated).

Figure 4A:
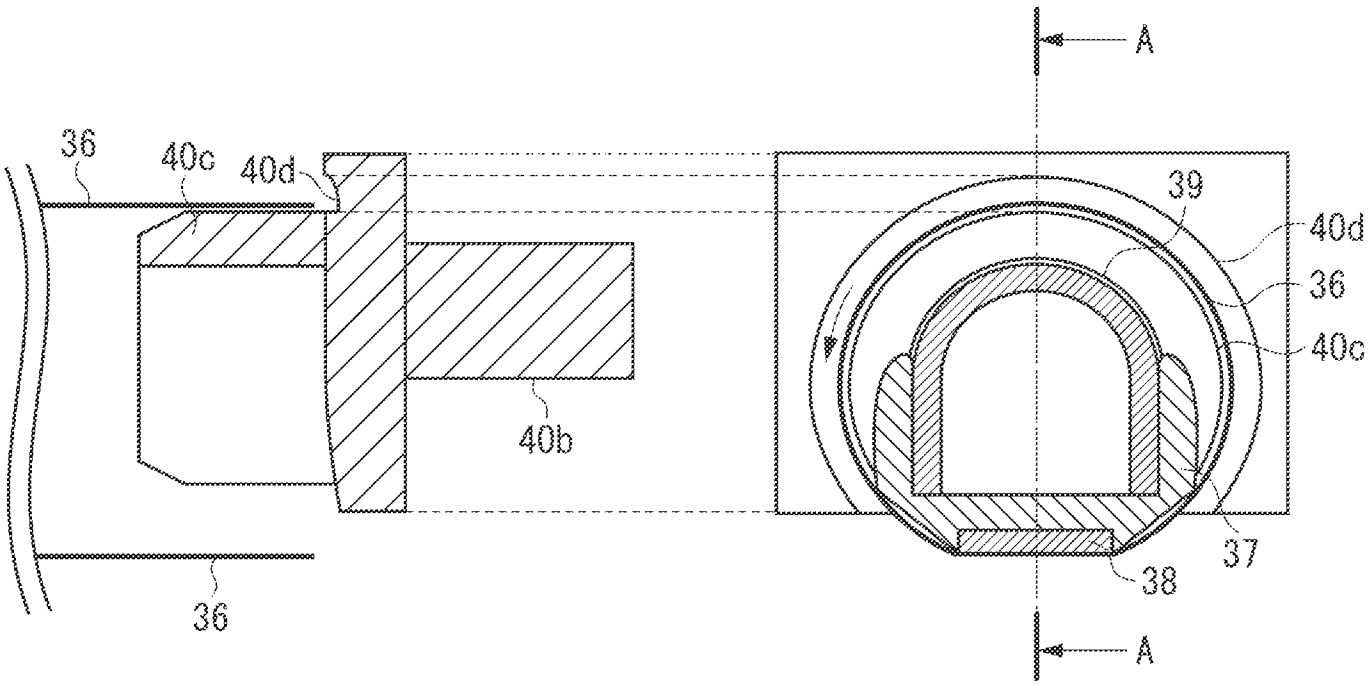
FIG. 4A includes a sectional view of a film assembly according to the first exemplary embodiment taken along a line perpendicular to a film generatrix direction (the diagram on the right-hand side), and a sectional view of the same taken along a line A-A (the diagram on the left-hand side).
Figure 4B:
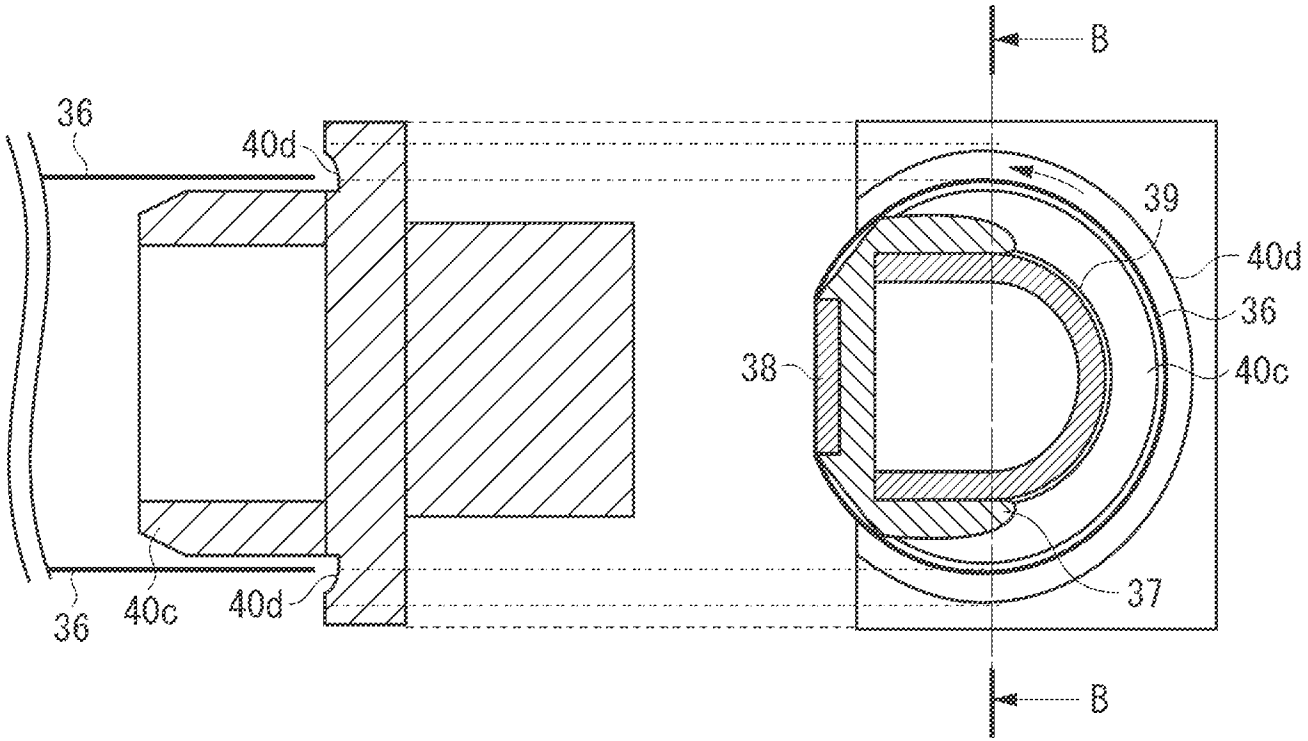
FIG. 4B includes a sectional view of the film assembly according to the first exemplary embodiment taken along a line perpendicular to the film generatrix direction (the diagram on the right-hand side), and a sectional view of the same taken along a line B-B (the diagram on the left-hand side).

Next, the regulation member 40 according to the first exemplary embodiment will be described. FIG. 4A includes a sectional view of the film assembly 31 according to the first exemplary embodiment taken along a line perpendicular to the generatrix direction thereof (the diagram on the right-hand side), and a sectional view taken along a line A-A (the diagram on the left-hand side). FIG. 4B includes a sectional view of the film assembly 31 according to the first exemplary embodiment taken along a line perpendicular to the generatrix direction thereof (the diagram on the right-hand side), and a sectional view taken along a line B-B (the diagram on the left-hand side).

The regulation member 40 includes a film inner peripheral regulation surface 40*c* as a first regulation surface and a regulation surface 40*d* as a second regulation surface, and serves to regulate the position of the film 36 when deviation is generated in the film.

The mechanism by which film deviation is generated will be described. During a normal fixing operation, the axial direction of the pressure roller 32 and the generatrix direction of the film 36 are not always perfectly parallel to each other but may exhibit a crossing angle due to a tolerance in production. In addition, even when the axial direction of the pressure roller 32 and the generatrix direction of the film 36 are parallel to each other, there may be generated a difference between the right and left sides in the feeding speed of the film 36 driven to rotate due to a difference between the right and left sides in pressurization force attributable to the pressure spring 42. In such cases, when the film 36 is rotated, a force causing the film to move in the radial direction and the generatrix direction of the film (hereinafter referred to as the film deviation force) is exerted on the film 36, resulting in generation of deviation in the film. Apart from the normal fixing operation, film deviation may be generated when a user pulls out the recording material in a direction at an angle with respect to the recording material conveyance direction due to generation of jamming with the recording material being pinched by the nip portion N.

When such film deviation is generated, the film inner peripheral regulation surface 40*c* comes into contact with an end portion inner peripheral surface of the film 36 to regulate the movement in the radial direction of the film 36. The film inner peripheral regulation surface 40*c* is in the form of a tube with its portion near the nip portion N cut out. A diameter of the film inner peripheral regulation surface 40*c* is slightly smaller than an inner diameter of the end portion inner peripheral surface of the film 36. The sectional configuration of the film inner peripheral regulation surface 40*c* taken along a line perpendicular to the generatrix direction of the film 36 is alike to the configuration of the film 36 when it is pinched and pressed by the heater 38 and the pressure roller 32 at the nip portion N.

According to the first exemplary embodiment, an outer diameter A of the film inner peripheral regulation surface 40*c* and an inner diameter D of the inner peripheral surface are set so as to satisfy the following formula (1):

$$1.00<D/A<1.07 \quad (1)$$

In the first exemplary embodiment, D/A=1.035. The outer diameter of the film inner peripheral regulation surface 40*c* of the regulation member 40 is 17.4 mm, and the inner diameter of the inner peripheral surface is 18.0 mm.

By satisfying the formula (1), a distance in the radial direction between the end portion inner peripheral surface of the film 36 and the film inner peripheral regulation surface 40*c* is reduced, and the film inner peripheral regulation surface 40*c* is allowed to easily function as a backup for the inner peripheral surface of the film 36.

Next, the regulation surface 40*d* constituting a feature of the first exemplary embodiment will be described. The regulation surface 40*d* is configured to regulate the movement of the film 36 in the generatrix direction of the film 36 when deviation is generated in the film. The regulation surface 40*d* is formed by the portion except for the portion near the nip portion. This is due to the fact that the film 36, which is firmly constrained by the nip portion N, lacks flexibility, so that a local deforming stress is generated when the film 36 receives a deviation force near the nip portion, which may cause damage of the end portion of the film.

The regulation surface 40*d*, which constitutes a feature of the first exemplary embodiment, is a concave and curved surface area. As described above, a movement range in the radial direction of the film 36 is regulated by the film inner peripheral regulation surface 40*c*. At least, an area of the regulation surface 40*d* facing to the movement range of the end surface in the film generatrix direction at this time is the concave and curved surface area.

The concave and curved surface is depicted as a circular arc in a sectional view taken along an arbitrary line perpendicular to the generatrix direction of the film 36. With respect to the concave and curved surface, a radius of the circular arc increases as it extends toward the film 36 side in the generatrix direction of the film 36, and a change ratio of the radius decreases as it extends toward the film side in the generatrix direction of the film 36.

Figure 11:
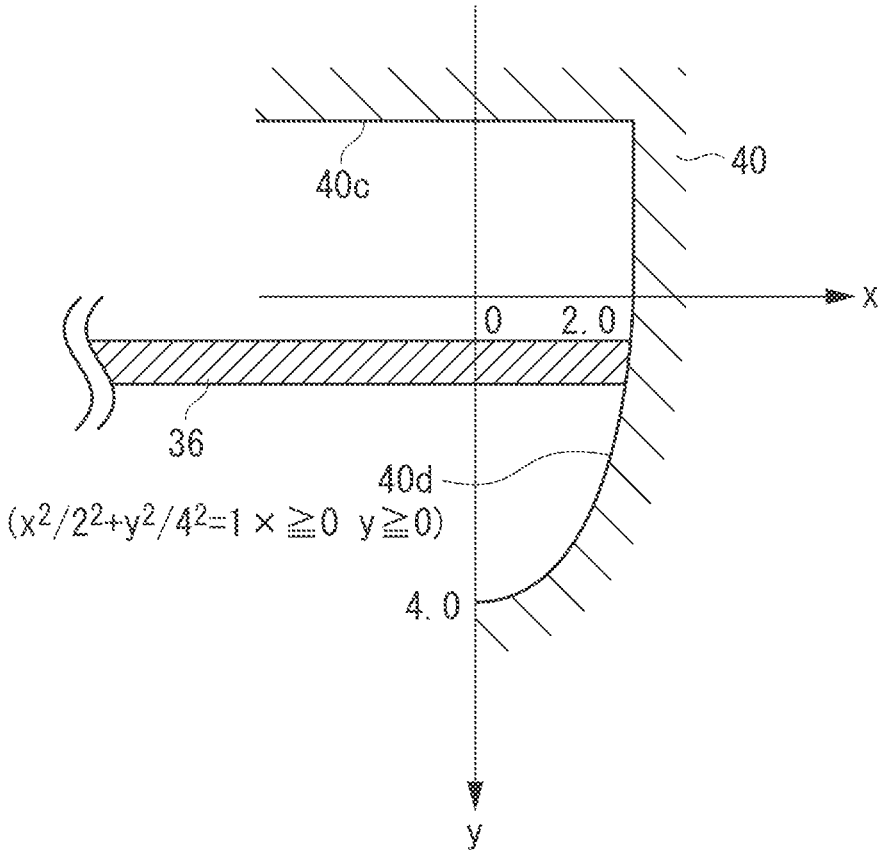
FIG. 11 is a sectional view illustrating a shape of a regulation surface according to the first exemplary embodiment.

The configuration of the regulation surface 40*d* according to the first exemplary embodiment will be described specifically. FIG. 11 is a sectional view of the film 36 and the regulation member 40 taken along a line parallel to the nip portion N. It is an enlarged view of the portion of the end portion of the film held in contact with the regulation surface 40*d*. In FIG. 11, a y-direction is the radial direction of the film 36. The regulation surface 40*d* is a concave and curved surface exhibiting a line including a part of an ellipse of a minor axis of 2 mm and a major axis of 4 mm in this cross section ($x^2/2^2+y^2/4^2=1$; $x\geq 0$; $y\geq 0$). An area constituting a part of this ellipse is a concave and curved surface area increasing in curvature as it extends in the radial direction of the film 36.

The effects of the first exemplary embodiment will be described in comparison with a comparative example. The comparative example differs from the first exemplary embodiment solely in the configuration of a regulation surface 401*d* of a regulation member 401. Otherwise, it is of the same construction as the first exemplary embodiment, so a description thereof will be omitted.

FIGS. 5A through 5C and FIGS. 6A and 6B are sectional views of the regulation member 401 and the film 36 according to the comparative example in which the film 36 is equally divided into two portions in a direction in a film assembly 32 is pressurized. The regulation surface 401*d* according to the comparative example is a surface exhibiting a slope straight in the radial direction. A movement range of the film 36 in the radial direction is regulated by the film inner peripheral regulation surface 401*c*. An area of the regulation surface 401*d* facing to the movement range in the generatrix direction of the film at this time is at least a surface exhibiting a slope straight in the radial direction.

On an arbitrary cross section taken along a line perpendicular to the generatrix direction of the film 36, the surface exhibiting a slope straight in the radial direction is depicted as an circular arc. A radius of the circular arc increases gradually toward the film 36 side in the generatrix direction of the film 36, and a radius change ratio is constant toward the film 36 side in the generatrix direction of the film 36.

Figure 7:
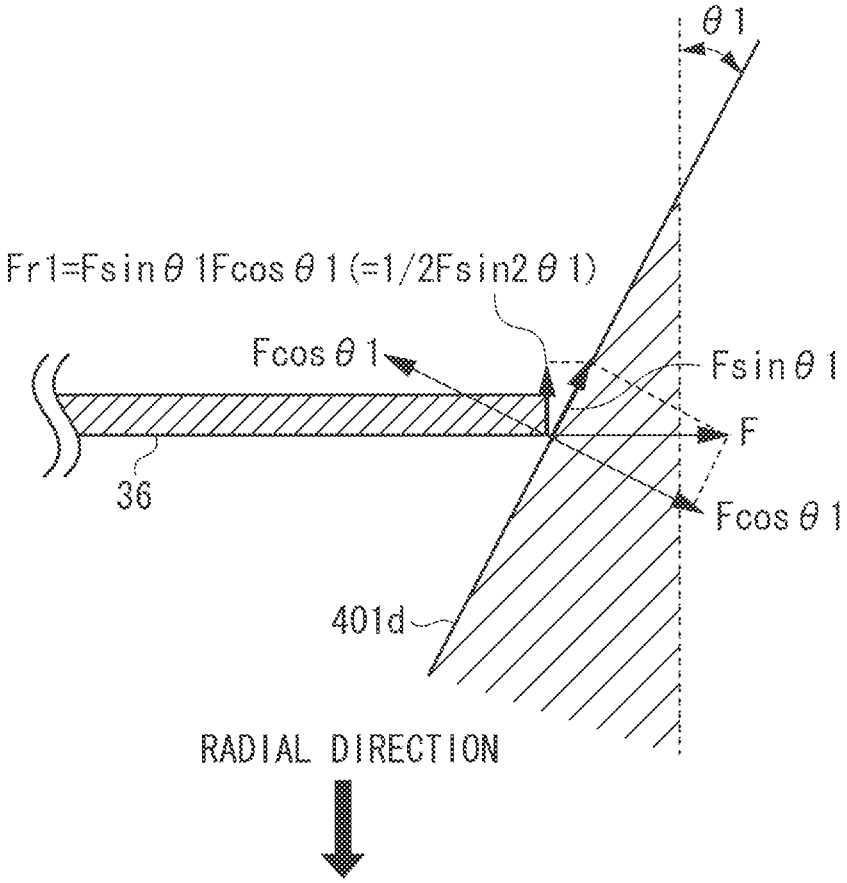
FIG. 7 illustrates equilibrium of force when the film and the regulation surface are brought into contact with each other in the comparative example.

FIG. 7 illustrates the equilibrium of force when a film deviation force F is applied to the film 36 and the end portion of the film is brought into contact with an arbitrary contact point on the regulation surface 401*d*. The equilibrium of force will be described in detail below.

It is supposed that the above-described slope crosses an imaginary plane including the end surface in the generatrix direction of the film 36 at an angle θ1. Then, the film deviation force F can be divided into a component force (F cos θ1) in a direction perpendicular to the regulation surface 401*d* and a component force (F sin θ1) in a direction parallel to the regulation surface 401*d*.

The component force (F cos θ1) in the direction perpendicular to the regulation surface 401*d* is in equilibrium with a normal force of the regulation surface 401*d*. The component force F sin θ1 in the direction parallel to the regulation surface 401*d* can be further divided into a force in the generatrix direction of the film 36 and a component force (½F sin 2θ1) in a direction orthogonal to the film generatrix direction. The component force (½F sin 2θ1) in the direction orthogonal to the film generatrix direction may be a force bending the end portion of the film toward the film inner peripheral regulation surface 40*c* side (hereinafter referred to as the inward force Fr1).

In the comparative example, the angle θ1 is constant in the radial direction of the film 36. Accordingly, in the comparative example, if the film deviation force F and the angle θ1 are not changed, the inward force Fr1 (=½F sin 2θ1) is constant in the radial direction of the film 36 regardless of the contact point. In addition, if the deviation force F is the same, the inward force Fr1 can be adjusted by adjusting the angle θ1.

Figure 9A:
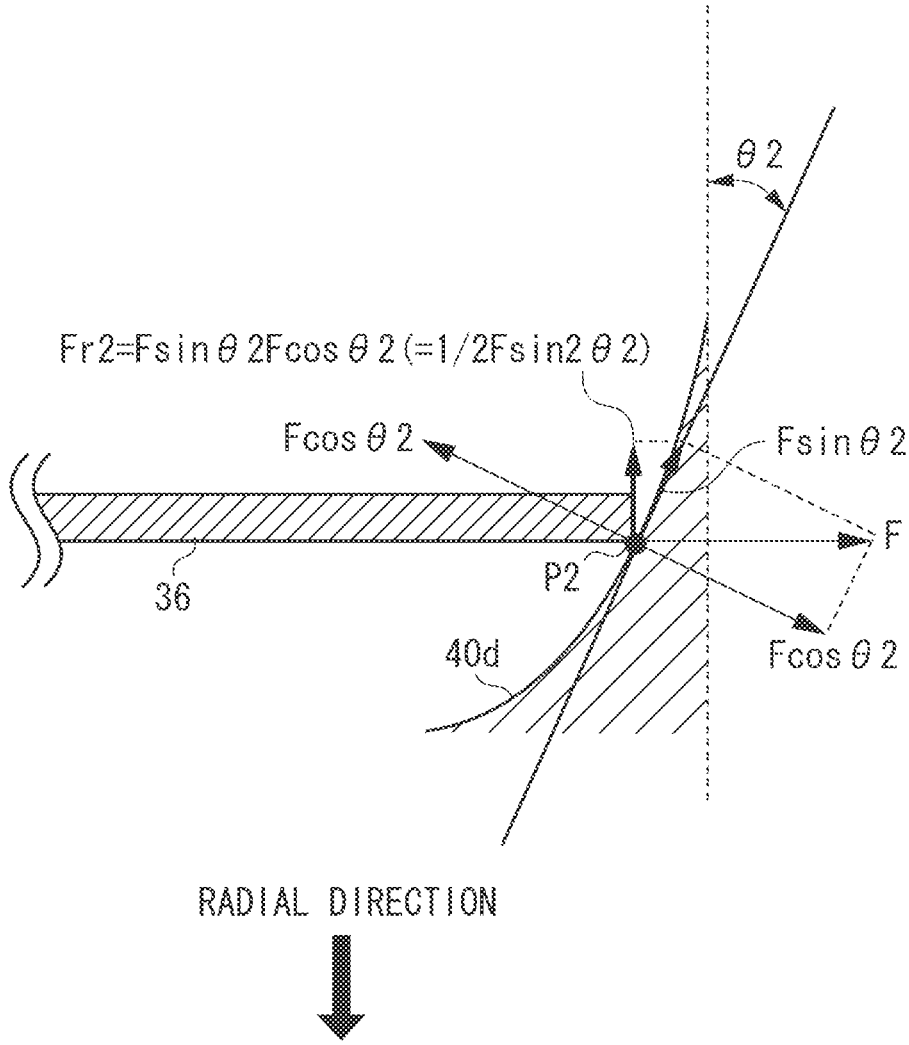
FIGS. 9A and 9B illustrate equilibrium of force when the film and the regulation surface are brought into contact with each other in the first exemplary embodiment.

Subsequently, the inward force applied to the end portion of the film in a case where the regulation member 40 according to the first exemplary embodiment is used will be described. FIG. 9A is a sectional view illustrating the equilibrium of force when the film deviation force F is applied to the film 36 and the end portion of the film is brought into contact with the regulation surface 40*d* at a contact point P2. A tangent of the regulation surface 40*d* at the contact point P2 crosses a line obtained by projecting an imaginary plane including the end surface in the generatrix direction of the film 36 onto the above-described cross section at an angle θ2. The deviation force F of the regulation surface 40*d* at the contact point P2 can be divided into a component force (F cos θ2) in a direction perpendicular to the tangent of the regulation surface 40*d* at the contact point P2 and a component force (F sin θ2) in a direction parallel to the regulation surface 40*d*. The component force (F cos θ2) in the direction perpendicular to the regulation surface 40*d* is in equilibrium with a normal reaction of the regulation surface 40*d*. The component force (F sin θ2) in the direction parallel to the film slope can be further divided into a component force in the generatrix direction of the film 36 and a component force (½F sin 2θ2) in a direction orthogonal to the film generatrix direction. The component force (½F sin 2θ2) in the direction orthogonal to the film generatrix direction is an inward force Fr2.

Figure 9B:
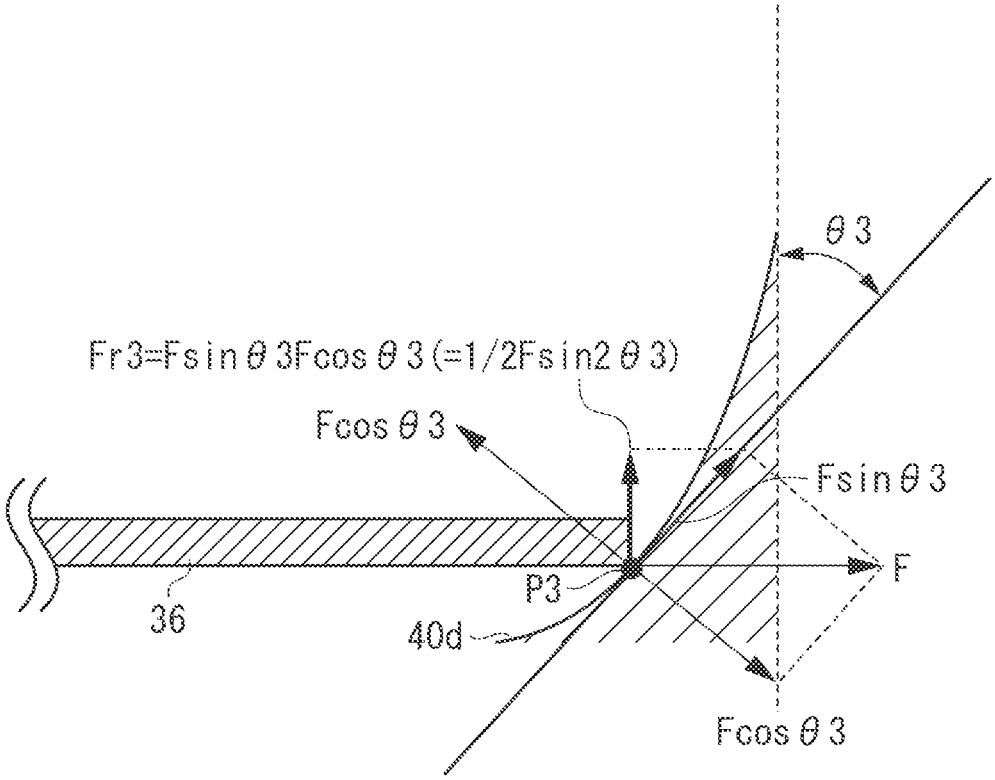

Next, an inward force Fr3 when a contact point at which the end portion of the film is brought into contact with the regulation surface 40*d* is a point P3 which is deviated in the radial direction from the contact point P2 will be described with reference to FIG. 9B. A tangent of the regulation surface 40*d* at the contact point P3 crosses a line obtained by projecting an imaginary plane including the end surface in the generatrix direction of the film 36 onto the above-described cross section at an angle θ3. By using the deviation force F1 and the above-described angle θ3, the inward force Fr3 at the contact point P3 can be expressed as ½F sin 3θ3. Since θ3>θ2, Fr3>Fr2 is obtained. In other words, it can be seen that the inward force applied to the end portion of the film in the first exemplary embodiment increases gradually toward the radial direction (where 0<θ<45°).

Figure 10:
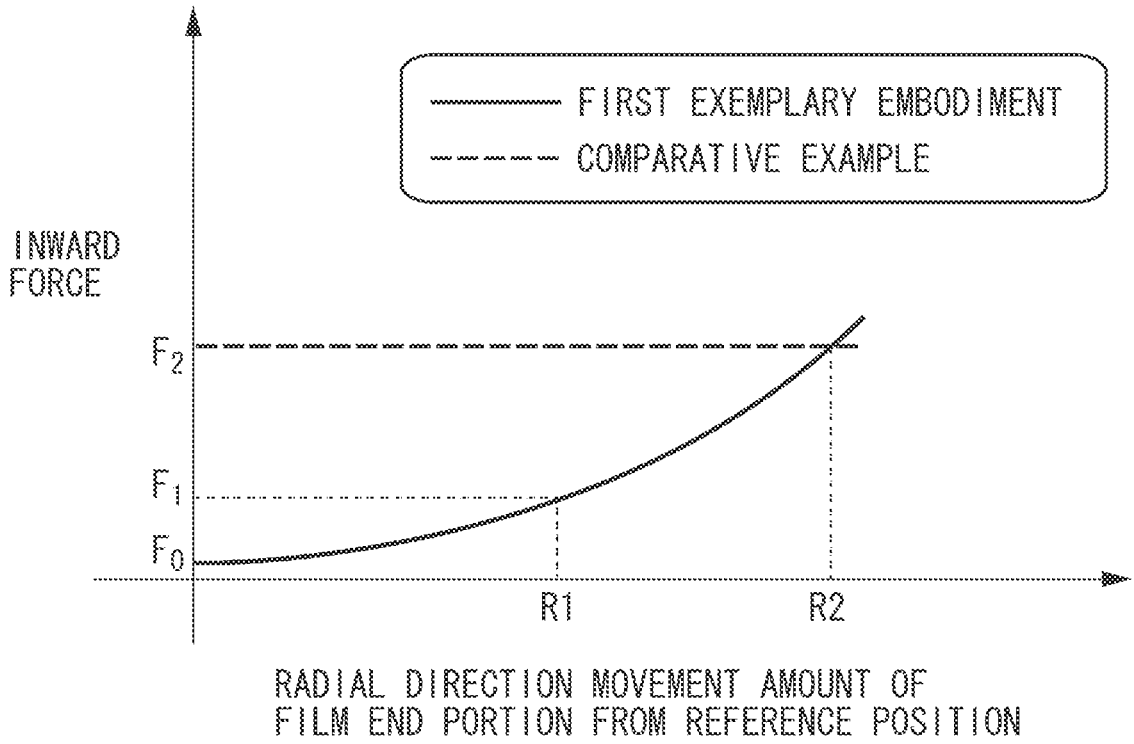
FIG. 10 illustrates the relationship between a movement amount of the end portion of the film in the radial direction from a reference position and an inward force in the first exemplary embodiment and the comparative example.
Figure 12:
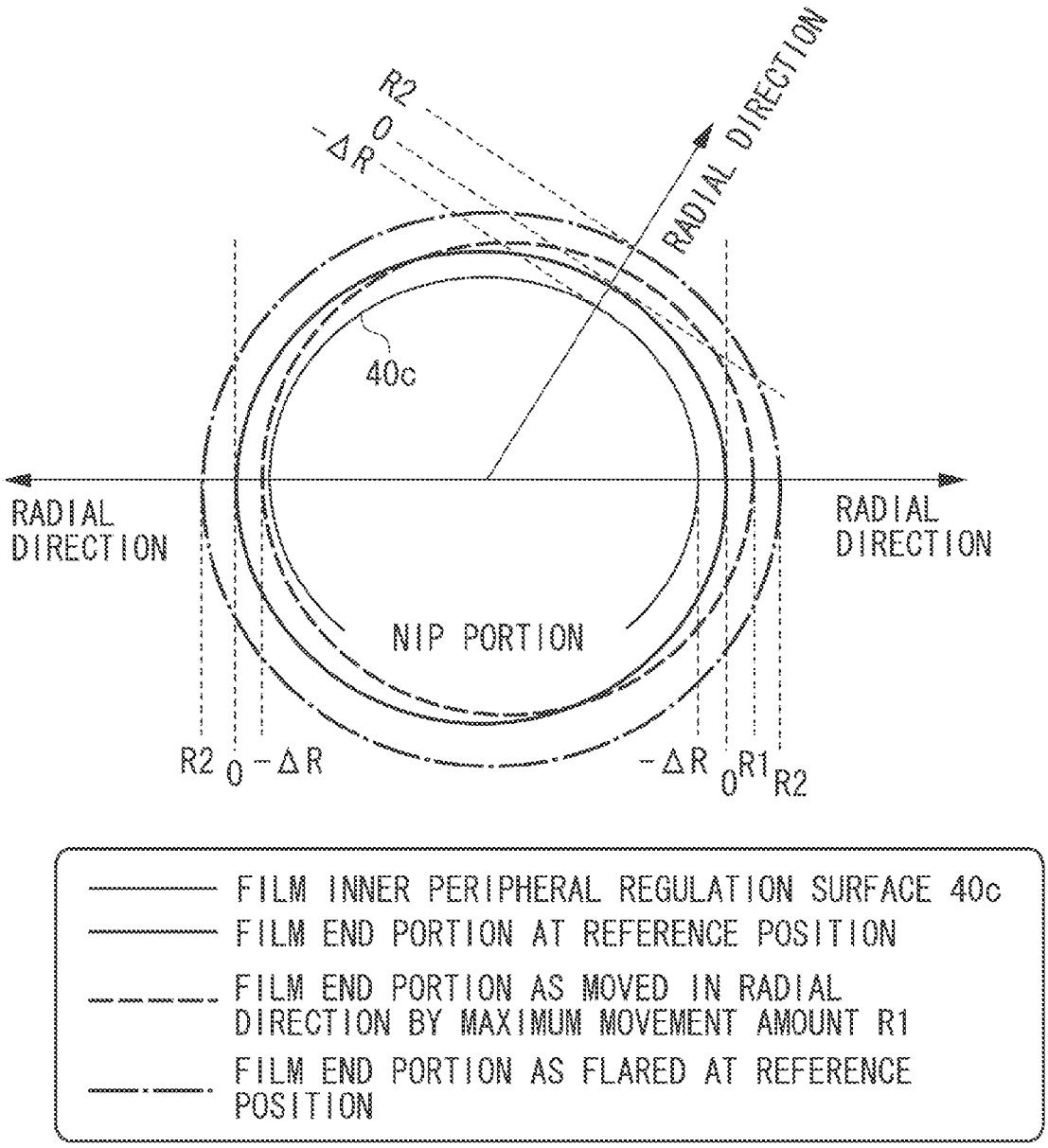
FIG. 12 illustrates a reference position in the radial direction of the end portion of the film in the first exemplary embodiment.

Next, referring to FIG. 10, comparison will be made between the first exemplary embodiment and the comparative example in terms of the relationship between the movement amount of the end portion of the film in the radial direction from a reference position and the magnitude of the inward force. The above-described reference position will be described with reference to FIG. 12, which illustrates a positional relationship between the end portion of the film and the film inner peripheral regulation surface 40*c* (401*c*) as seen from the generatrix direction of the film 36. In FIG. 12, the reference position refers to a position of the end portion of the film where a distance (ΔR) in the radial direction between the end portion inner peripheral surface of the film 36 and the film inner peripheral regulation surface 40*c* (401*c*) of the regulation member 40 is the same in an arbitrary radial direction.

In the graph in FIG. 10, the horizontal axis indicates the movement amount of the end portion of the film in the radial direction from the reference position, and the vertical axis indicates the inward force. The movement amount of the end portion of the film in the radial direction from the reference position includes a movement amount due to local deformation of the end portion of the film such as flaring or inward bending in addition to the movement in the radial direction of the film 36 itself. As described above, the movement range of the film 36 in the radial direction is regulated by the film inner peripheral regulation surface 40*c*. In this regulated movement range, the maximum movement amount that the end portion of the film 36 can move in the radial direction from the reference position will be referred to as R1 (which does not include the movement due to deformation of the end portion of the film). The maximum movement amount R1 approximately coincides with half the difference between the outer diameter of the film inner peripheral regulation surface 40*c* (401*c*) and the inner diameter of the end portion inner peripheral surface of the film 36. The positional relationship between the end portion of the film and the film inner peripheral regulation surface 40*c* (401*c*) when the end portion of the film moves in the radial direction by the amount R1 is as illustrated in FIG. 12.

In the case of the comparative example, the magnitude of the inward force Fr1 applied to the end portion of the film is a constant value $F_2$ when the movement amount of the end portion of the film in the radial direction from the reference position ranges from 0 to R1.

Next, the magnitude $F_2$ of the inward force will be described. The movement amount of the end portion of the film in the radial direction from the reference position in the state in which the end portion of the film has been flared to the utmost in the radial direction without involving any damage of the end portion of the film, with the film 36 itself not moving in the radial direction (FIG. 5C), will be referred to as R2. The positional relationship between the end portion of the film and the film inner peripheral regulation surface 40*c* (401*c*) when the end portion of the film moves in the radial direction by the amount R2 is as illustrated in FIG. 12. The magnitude $F_2$ of the inward force is set to be large enough to prevent the damage of the end portion of the film when the end portion of the film is further flared when the movement amount of the end portion of the film in the radial direction from the reference position reaches R2.

Figure 6A:
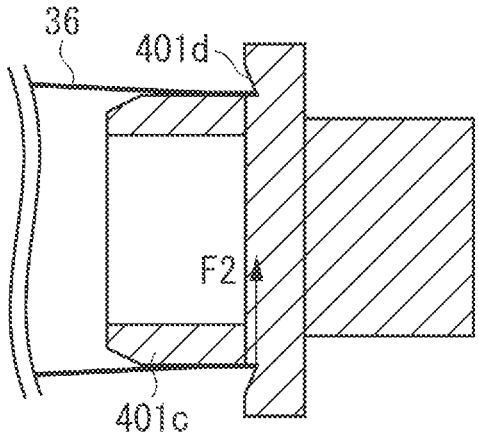
FIGS. 6A and 6B are sectional views of a film and a regulation surface according to the comparative example taken along a line parallel to the nip portion.

In the comparative example, when the movement amount of the end portion of the film in the radial direction from the reference position is zero (FIGS. 5A and 12), the end portion of the film is not bent even if the inward force of the magnitude F2 is applied thereto since the film inner peripheral regulation surface 401*c* functions as a backup (FIG. 6A).

Figure 5A:
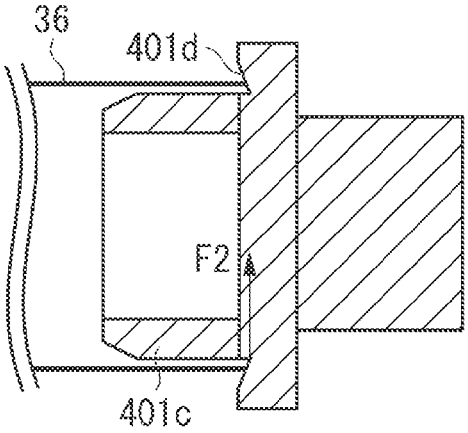
FIGS. 5A through 5C are sectional views of a film and a regulation surface according to a comparative example taken along a line parallel to a nip portion.
Figure 5B:
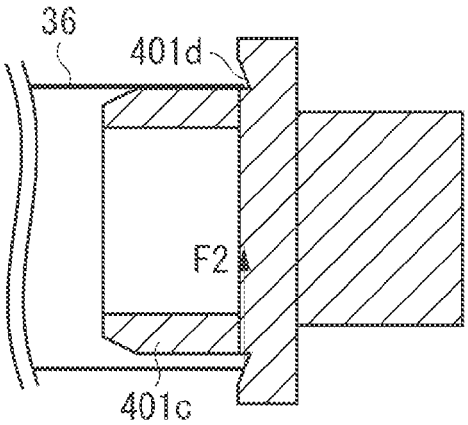
Figure 5C:
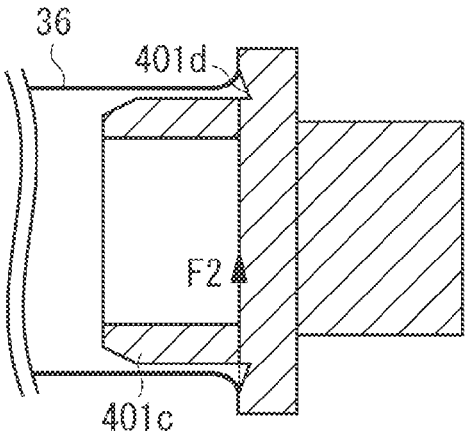
Figure 6B:
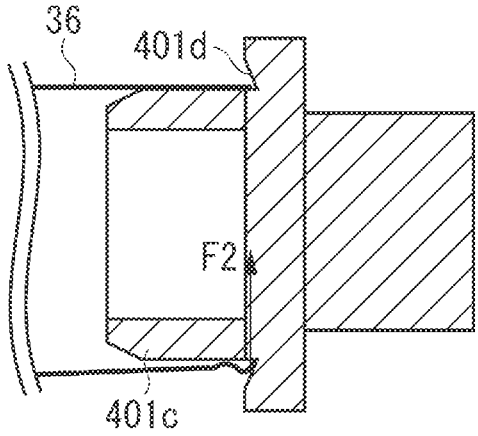

However, when, as illustrated in, e.g., FIGS. 5B and 12, the movement amount of the end portion of the film in the radial direction from the reference position reaches R1, there is generated a portion where the radial distance between the film inner peripheral surface and the film inner peripheral regulation surface 401*c* is enlarged. At this portion, it is difficult for the film inner peripheral regulation surface 401*c* to function as a backup. In this case, if the above-described inward force (of the magnitude $F_2$) exceeds the maximum value $F_1$ of the force that can prevent the end portion of the film from being bent due to the bending rigidity of the film itself, there is the possibility of the end portion of the film being bent to the film inner peripheral regulation surface 401*c* side as illustrated in FIG. 6B.

If the film thickness is further reduced in the future, the bending rigidity of the film 36 itself becomes lower and lower, so that the possibility of the generation of the above issue will increase.

On the other hand, as illustrated in FIG. 10, the inward force in the first exemplary embodiment increases as the movement amount of the end portion of the film in the radial direction from the reference position increases. Further, the increase ratio of the inward force gradually increases toward the radial direction of the film 36.

Figure 8A:
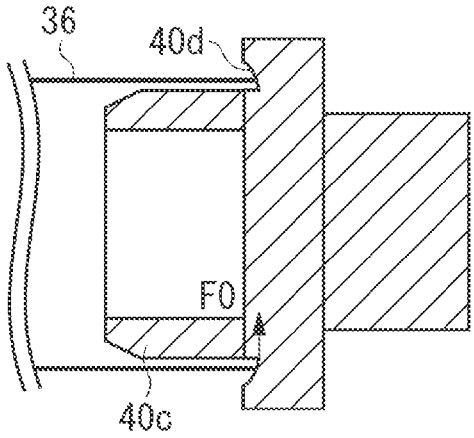
FIGS. 8A through 8C are sectional views of a film and a regulation surface according to the first exemplary embodiment taken along a line parallel to a nip portion.
Figure 8B:
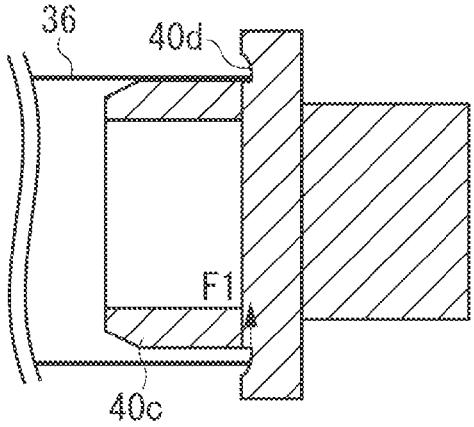
Figure 8C:
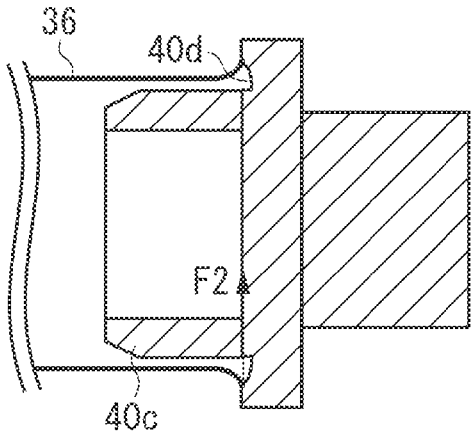

FIGS. 8A through 8C are sectional views taken along a line parallel to the nip portion N, illustrating the positional relationship between the film 36 and the regulation member 40 according to the first exemplary embodiment. FIG. 8A illustrates the case where the movement amount of the end portion of the film in the radial direction from the reference position is zero, and FIG. 8B illustrates the case where the movement amount of the end portion of the film from the reference position is R1. FIG. 8C illustrates the state in which the movement amount of the end portion of the film in the radial direction from the reference position is R2, with the end portion of the film being flared. In other words, as illustrated in FIG. 10, according to the first exemplary embodiment, until the movement amount of the end portion of the film in the radial direction from the reference position reaches R1, the magnitude of the inward force is suppressed to a level not larger than $F_1$. When the above-described movement amount reaches R2, it is possible to set the magnitude of the inward force to $F_2$. In this way, according to the first exemplary embodiment, it is possible to set the inward force to a magnitude according to the condition of the end portion of the film.

Thus, according to the first exemplary embodiment, while suppressing damage of the end portion of the film due to flaring thereof in the radial direction by applying the inward force to the end portion of the film, it is possible to suppress inward bending of the end portion of the film by that inward force.

While a heater is used as the nip portion forming member in the first exemplary embodiment, the nip portion forming member is not limited to the heater. For example, it is also possible for the nip portion forming member to be a slide plate configured to slide on the film inner surface through film rotation, with the slide plate or the film being heated by a heat source.

So long as it has a concave and curved surface, the regulation surface 40*d* is not limited to a concave and curved surface constituting a line including a part of an ellipse in a cross section parallel to the nip portion as in the first exemplary embodiment. For example, it is also possible to adopt a curved line to be expressed as a circular arc or an exponential function in the above-described cross section.

Figure 13A:
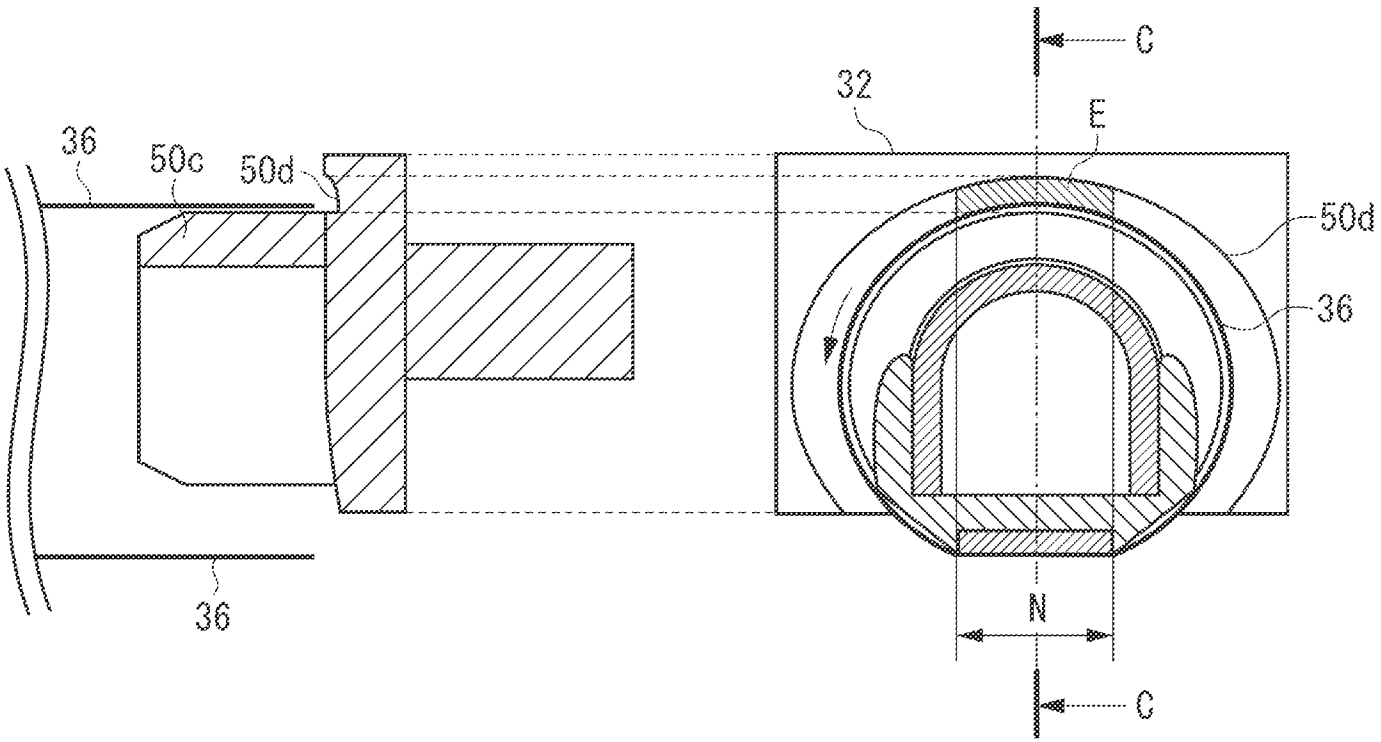
FIG. 13A includes a sectional view of a film assembly according to a second exemplary embodiment taken along a line perpendicular to the film generatrix direction (the diagram on the right-hand side), and a sectional view of the same taken along a line C-C (the diagram on the left-hand side).
Figure 13B:
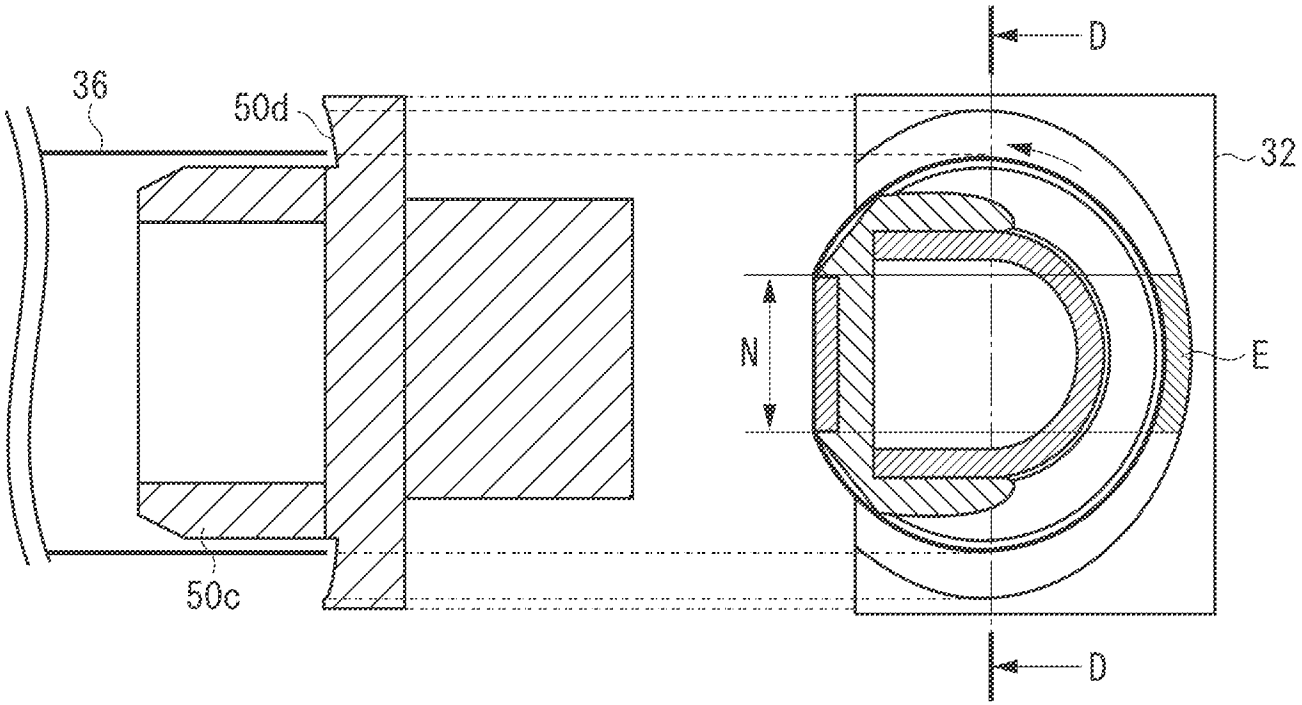
FIG. 13B includes a sectional view of the film assembly according to the second exemplary embodiment taken along a line perpendicular to the film generatrix direction (the diagram on the right-hand side), and a sectional view of the same taken along a line D-D (the diagram on the left-hand side).

A fixing apparatus according to a second exemplary embodiment will be described. FIG. 13A includes a sectional view of a film assembly 32 according to the second exemplary embodiment taken along a line perpendicular to a generatrix direction of a film (the diagram on the right-hand side), and a sectional view taken along a line C-C (the diagram on the left-hand side). FIG. 13B includes a sectional view of the film assembly according to the second exemplary embodiment taken along a line perpendicular to the generatrix direction of the film (the diagram on the right-hand side), and a sectional view taken along a line D-D (the diagram on the left-hand side).

The second exemplary embodiment differs from the first exemplary embodiment solely in the configuration of a film regulation surface 50*d* as a second regulation surface of a regulation member 50. Otherwise, it is of the same construction as the first exemplary embodiment, so a description thereof will be omitted.

The film 36 is firmly constrained at the nip portion N, so that the degree of freedom in movement of the film 36 is rather low regarding a pressing direction of the film assembly 32 of the radial direction of the film 36. Thus, the end portion in the generatrix direction of the film 36, i.e., the portion thereof near the nip portion N in a film rotational direction of the film 36, may be bent and suffer damage if an inward force applied thereto is large.

The regulation surface 50*d* constituting a feature of the second exemplary embodiment will be described. Also in the second exemplary embodiment, a movement range in the radial direction of the film 36 is regulated by the film inner peripheral regulation surface 50*c*. At least, an area of the film regulation surface 50*d* facing to the movement range of the end surface in the generatrix direction of the film 36 at this time is a concave and curved surface area as in the first exemplary embodiment. In addition, a first surface area of the film regulation surface 50*d* facing to the end surface in the generatrix direction of the film 36 on the side opposite to the portion pinched by the nip portion N of the film 36 in the rotational direction of the film 36 exhibits a larger curvature than a second surface area except for the first surface area of the concave and curved surface.

The configuration of the first surface area of the film regulation surface 50*d* according to the second exemplary embodiment will be specifically described. The first surface area is formed as a concave and curved surface constituting a line including a part of an ellipse of a minor axis of 2 mm and of a major axis of 4 mm ($x^2/2^2+y^2/4^2=1$; $x\geq 0$; $y\geq 0$) in a cross section in the radial direction (e.g., the cross section C-C) of a first surface area E on the opposite side of the nip portion N in the film rotational direction in FIGS. 13A and 13B. Next, the configuration of the other area (the second surface area) of the film regulation surface 50*d* will be specifically described. The second surface area is smoothly continuous with the end of the first surface area E in the circumferential direction, and is formed as a concave and curved surface constituting a line including a part of an ellipse of a minor axis of 2 mm and of a major axis of 6 mm ($x^2/2^2+y^2/6^2=1$; $x\geq 0$; $y\geq 0$) in a cross section in the radial direction (e.g., the section D-D). An ellipse of a minor axis of 2 mm and of a major axis of 6 mm exhibits a smaller curvature than an ellipse of a minor axis of 2 mm and a major axis of 4 mm. Accordingly, the inward force applied to the end portion of the film is smaller.

According to the second exemplary embodiment, the magnitude of the inward force applied to the end portion of the film is set smaller in the area near the nip portion, where the degree of freedom in the movement in the radial direction of the end portion of the film is low in the film rotational direction, than in the area far from the nip portion, so that it is possible to achieve a configuration advantageous to prevention of damage of the end portion of the film.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

What is claimed is:

1. A fixing apparatus for fixing a toner image onto a recording material by heating the recording material bearing the toner image at a nip portion while conveying the recording material, the fixing apparatus comprising:

a tubular film;

a nip portion forming member in contact with an inner surface of the film;

a pressure member that forms the nip portion with the nip portion forming member via the film; and a regulation member for regulating a movement of the film, the regulation member includes a first regulation surface facing an inner face of the film to regulate the movement of the film in a radial direction of the film and an second regulation surface facing an end surface of the film to regulate the movement of the film in a generatrix direction of the film, wherein the second regulation surface includes a concave and curved surface area which has a larger amount of curvature as the surface area extends in the radial direction of the film.

2. The fixing apparatus according to claim 1, wherein at least an area of the second regulation surface in a movable range of the film in the radial direction of the film is included in the concave and curved surface area.

3. The fixing apparatus according to claim 1, wherein the nip portion forming member includes a heater.

4. The fixing apparatus according to claim 1, wherein the surface area extends in a film circumferential direction.

5. A fixing apparatus for fixing a toner image onto a recording material by heating the recording material bearing the toner image at a nip portion while conveying the recording material, the fixing apparatus comprising:

a tubular film;

a nip portion forming member in contact with an inner surface of the film;

a pressure member that forms the nip portion with the nip portion forming member via the film; and a regulation member for regulating a movement of the film, the regulation member includes a first regulation surface facing an inner face of the film to regulate the movement of the film in a radial direction of the film and an second regulation surface facing an end surface of the film to regulate the movement of the film in a generatrix direction of the film, wherein the second regulation surface includes a concave and curved surface area in a circumferential direction which has a first surface area furthermost from the nip portion and a second surface area which is obtained by excluding the first surface area from the concave and curved surface area, and wherein a curvature of the first surface area is larger than a curvature of the second surface area.

6. The fixing apparatus according to claim 5, wherein the film moves in the radial direction within the concave and curved surface area.

7. The fixing apparatus according to claim 5, wherein the nip portion forming member includes a heater.

8. A fixing apparatus for fixing a toner image onto a recording material by heating the recording material bearing the toner image at a nip portion while conveying the recording material, the fixing apparatus comprising:

a tubular film;

a pressure member that forms the nip portion between the pressure member and the film; and a regulation member having a first regulation surface opposing an inner surface of the film to regulate a movement of the film in a radial direction of the film and a second regulation surface opposing an end surface of the film to regulate a movement of the film in a generatrix direction of the film, wherein the second regulation surface includes a concave and curved surface area which has a larger amount of curvature in a radial direction of the film.

9. A fixing apparatus for fixing a toner image onto a recording material by heating the recording material bearing the toner image at a nip portion while conveying the recording material, the fixing apparatus comprising:

a tubular film;

a pressure member that forms the nip portion between the pressure member and the film; and a regulation member having a regulation surface opposing an end surface of the film to regulate a movement of the film in a generatrix direction of the film; and a heater contacting with an inner surface of the film, wherein the regulation surface includes a concave and curved surface area which has a larger amount of curvature in a radial direction of the film.

10. The fixing apparatus according to claim 9, wherein the heater forms the nip portion with the pressure member via the film.

11. A fixing apparatus for fixing a toner image onto a recording material by heating the recording material bearing the toner image at a nip portion while conveying the recording material, the fixing apparatus comprising:

a tubular film;

a pressure member that forms the nip portion between the pressure member and the film; and a regulation member having a regulation surface opposing an end surface of the film to regulate a movement of the film in a generatrix direction of the film, wherein the regulation surface includes a concave and curved surface area which has a larger amount of curvature in a radial direction of the film, and wherein the concave and curved surface area extends in a film circumferential direction.

12. A fixing apparatus for fixing a toner image onto a recording material by heating the recording material bearing the toner image at a nip portion while conveying the recording material, the fixing apparatus comprising:

a tubular film;

a pressure member that forms the nip portion between the pressure member and the film; and a regulation member having a regulating surface opposing an end surface of the film to regulate a movement of the film in a generatrix direction of the film, wherein the regulation surface includes an inclined area in which an inclined angle of the regulation surface to a virtual plane including the end surface of the film is larger in a radial direction of the film.

13. The fixing apparatus according to claim 12, wherein the regulation member includes a second regulation surface opposing an inner surface of the film to regulate a movement of the film in the radial direction of the film.

14. The fixing apparatus according to claim 12, further comprising a heater contacting with an inner surface of the film.

15. The fixing apparatus according to claim 14, wherein the heater forms the nip portion with the pressure member via the film.

16. The fixing apparatus according to claim 12, wherein the inclined area extends in a film circumferential direction.

17. A fixing apparatus for fixing a toner image onto a recording material by heating the recording material bearing the toner image at a nip portion while conveying the recording material, the fixing apparatus comprising:

a tubular film;

a pressure member that forms the nip portion between the pressure member and the film; and a regulation member for regulating a movement of the film, the regulation member has a regulation surface opposing an end surface of the film and contacting with the end surface when the film moves in a generatrix direction of the film, wherein the regulation surface includes a concave and curved surface area, and wherein the regulation member includes a second regulation surface opposing an inner surface of the film to regulate a movement of the film in the radial direction of the film.

18. The fixing apparatus according to claim 17, further comprising a heater contacting with an inner surface of the film.

19. The fixing apparatus according to claim 18, wherein the heater forms the nip portion with the pressure member via the film.

20. A fixing apparatus for fixing a toner image onto a recording material by heating the recording material bearing the toner image at a nip portion while conveying the recording material, the fixing apparatus comprising:

a tubular film;

a pressure member that forms the nip portion between the pressure member and the film; and a regulation member for regulating a movement of the film, the regulation member has a regulation surface opposing an end surface of the film and contacting with the end surface when the film moves in a generatrix direction of the film, wherein the regulation surface includes a concave and curved surface area, and wherein the concave and curved area extends in a film circumferential direction.

* * * * *